US010508505B2

(12) United States Patent
Mansukh et al.

(10) Patent No.: US 10,508,505 B2
(45) Date of Patent: Dec. 17, 2019

(54) FLOW-BY HOLES WITH GALLERY AND CHANNEL ARRANGEMENT ON WELLHEAD AND TUBULAR HANGER

(71) Applicant: Vetco Gray Inc., Houston, TX (US)

(72) Inventors: Mayur Mansukh, Houston, TX (US); Aniruddha D. Gadre, Houston, TX (US); Daniel Caleb Benson, Houston, TX (US); David Lawrence Ford, Houston, TX (US)

(73) Assignee: VETCO GRAY, LLC, Houston, TX (US)

( * ) Notice: Subject to any disclaimer, the term of this patent is extended or adjusted under 35 U.S.C. 154(b) by 1079 days.

(21) Appl. No.: 14/496,259

(22) Filed: Sep. 25, 2014

(65) Prior Publication Data

US 2015/0114668 A1 Apr. 30, 2015

Related U.S. Application Data

(60) Provisional application No. 61/896,438, filed on Oct. 28, 2013.

(51) Int. Cl.
*E21B 19/00* (2006.01)
*E21B 43/10* (2006.01)
*E21B 33/043* (2006.01)

(52) U.S. Cl.
CPC ..... *E21B 19/00* (2013.01); *E21B 33/043* (2013.01); *E21B 43/10* (2013.01)

(58) Field of Classification Search
CPC ..... E21B 19/00; E21B 33/03; E21B 33/035; E21B 33/04; E21B 33/043; E21B 33/05; E21B 43/10
See application file for complete search history.

(56) References Cited

U.S. PATENT DOCUMENTS 4,665,979 A * 5/1987 Boehm, Jr. ..... E21B 33/04 166/208
7,798,231 B2 9/2010 Ford
(Continued)

FOREIGN PATENT DOCUMENTS

EP 2239412 A2 10/2010
GB 2462520 A 2/2010

OTHER PUBLICATIONS

International Search Report and Written Opinion issued in connection with corresponding PCT Application No. PCT/US2014/061480 dated Jun. 2, 2015.

*Primary Examiner* — Robert E Fuller
*Assistant Examiner* — Christopher J Sebesta
(74) *Attorney, Agent, or Firm* — Hogan Lovells US LLP

(57) ABSTRACT

A wellhead assembly includes a tubular wellhead housing having a bore and an annular gallery slot. The annular gallery slot is defined by an enlarged inner diameter of the bore. A tubular hanger is selectively landed in the bore of the wellhead housing, defining an annular cavity between the bore and an outer diameter of the tubular hanger. The tubular hanger is supported by the wellhead housing with a hanger support located in the annular cavity. A flow-by passage is in fluid communication with the annular cavity at locations above and below the hanger support. The flow-by passage intersects with the gallery slot and intersects an outer radial surface of the tubular hanger.

19 Claims, 4 Drawing Sheets

(56) References Cited

U.S. PATENT DOCUMENTS

| | | | | |
|---|---|---|---|---|
| 2005/0274526 | A1* | 12/2005 | Thomas | E21B 33/038 166/348 |
| 2010/0038089 | A1* | 2/2010 | Gette | E21B 33/04 166/338 |
| 2010/0243238 | A1* | 9/2010 | Gette | E21B 33/04 166/208 |
| 2012/0012302 | A1 | 1/2012 | Vogel et al. | |
| 2013/0068466 | A1 | 3/2013 | Ghumre et al. | |

* cited by examiner

FLOW-BY HOLES WITH GALLERY AND CHANNEL ARRANGEMENT ON WELLHEAD AND TUBULAR HANGER

CROSS REFERENCE TO RELATED APPLICATION

This application claims priority to and the benefit of U.S. Provisional Application Ser. No. 61/896,438 filed Oct. 28, 2013, titled "Flow-By Holes with Gallery and Channel Arrangement on Subsea Wellhead and Casing Hanger," the full disclosure of which is hereby incorporated herein by reference in its entirety for all purposes.

BACKGROUND

1. Field of Invention

This invention relates in general to wellheads and tubular hangers for use in oil and gas wells, and in particular to flow-by holes on wellheads and tubular hangers.

2. Description of Prior Art

A subsea well that is capable of producing oil or gas typically has a conductor housing secured to a string of conductor pipe which extends some short depth into the well. A wellhead housing lands in the conductor housing and secures to an outer or first string of casing, which extends coaxially through the conductor to a deeper depth into the well. Depending on the particular conditions of the geological strata above the target zone (typically, either an oil or gas producing zone or a fluid injection zone), one or more additional casing strings will generally extend through the outer string of casing to increasing depths in the well until the well is cased to the final depth. Each string of casing is supported at the upper end by a tubular hanger, such as a casing hanger, which usually lands in and is supported by the wellhead.

Where multiple tubular hangers are landed in the wellhead housing, they are generally stacked on one another in the wellhead housing. Between each tubular hanger and the wellhead housing, a tubular hanger packoff is set to isolate each annular space between strings of casing. The lowest string of casing extends into the well to the final depth, this being the production casing. The strings of casing between the outer casing and the production casing are usually referred to as intermediate casing strings. When each string of casing is suspended in the wellhead housing, a cement slurry is flowed through the inside of the casing, out of the bottom of the casing, and back up the outside of the casing to cement the casing through the formation.

In order to provide a path for the cement slurry and other well fluids to return, flow-by passages are sometimes provided through the tubular hanger through which the well fluids can flow. In some current tubular hangers, the flow-by passages extend through a portion of an annular upward shoulder of the tubular hanger that traditionally supports the tubular hanger packoff and can also support a lock-ring.

SUMMARY OF THE DISCLOSURE

The methods and systems of the current disclosure provide a flow path for well fluids that does not pass through a portion of an annular upward shoulder of the tubular hanger. The tubular hanger flow-by passages instead open on an outer diameter of the tubular hanger and are axially level with a gallery slot formed in the wellhead housing. Embodiments of this disclosure therefore provide additional surface area on the annular upward shoulder of the tubular hanger which can be used as a bearing interface, and increase the bearing capacity of the annular upward shoulder. The annular upward shoulder of the tubular hanger is structurally stronger than some current tubular hangers that have passages through the annular upward shoulder. This allows using a smaller lock-ring without having to change the thickness of the tubular hanger. In addition, the lock-ring can be integral to the tubular hanger without interfering with the flow of well fluids through the tubular hanger. Embodiments of this disclosure also allow for the area of the fluid path to be increased by taking material from the wellhead housing instead of from the tubular hanger.

In an embodiment of this disclosure, a wellhead assembly includes a tubular wellhead housing having a bore and an annular gallery slot. The annular gallery slot is defined by an enlarged inner diameter of the bore. A tubular hanger is selectively landed in the bore of the wellhead housing, defining an annular cavity between the bore and an outer diameter of the tubular hanger. The tubular hanger is supported by the wellhead housing with a hanger support located in the annular cavity. A flow-by passage is in fluid communication with the annular cavity at locations above and below the hanger support. The flow-by passage intersects with the gallery slot and intersects an outer radial surface of the tubular hanger.

In another embodiment of this disclosure, a wellhead assembly has a tubular wellhead housing. The tubular wellhead housing includes a bore, an annular gallery slot defined by an enlarged inner diameter of the bore, and a plurality of flow-by slots. Each of the flow-by slots extends axially upward from the gallery slot. A tubular hanger is selectively landed in the bore of the wellhead housing defining an annular cavity between the bore and an outer diameter of the tubular hanger. The tubular hanger is supported by the wellhead housing with a hanger support located in the annular cavity. An annular upward shoulder is located on an outer diameter of the tubular hanger. A flow-by passage has a first end open to the annular cavity above the hanger support axially level with the gallery slot, and a second end in fluid communication with the annular cavity below the hanger support. The first end of the flow-by passage is spaced axially apart from the annular upward shoulder.

In yet another embodiment of this disclosure, a method for completing a well with a wellhead assembly includes supporting a tubular hanger within a bore of a tubular wellhead housing with a hanger support, to define an annular cavity between the bore and an outer diameter of the tubular hanger. The wellhead housing has an annular gallery slot defined by an enlarged inner diameter of the bore. The well is pressurized to force a fluid upward through a flow-by passage that follows a path through the annular cavity below the hanger support, through an outer radial surface of the tubular hanger into the gallery slot, and into the annular cavity above the hanger support.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

Figure 1:
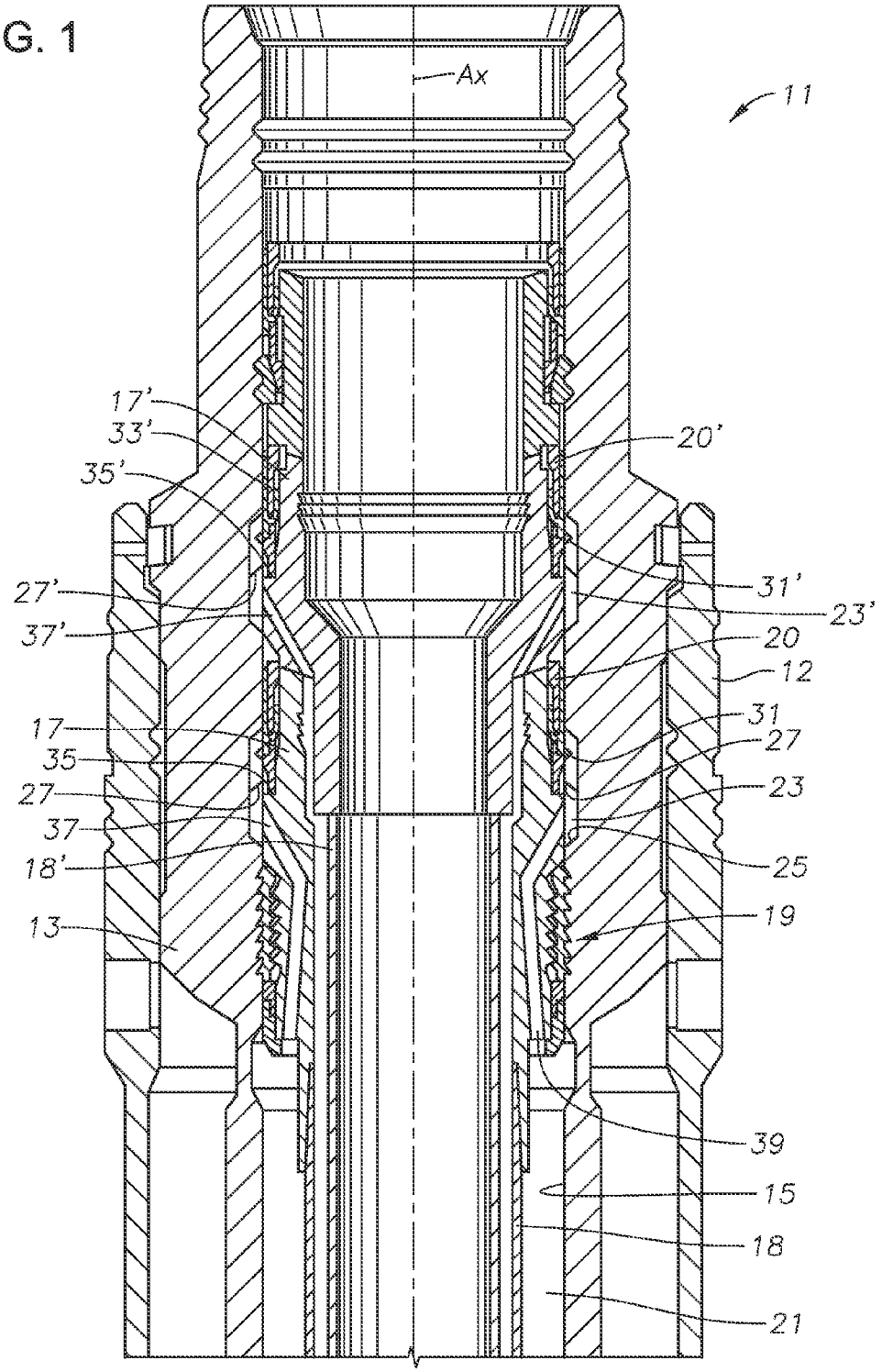
FIG. 1 is a section view of a wellhead assembly with the flow-by passages and gallery slot, in accordance with an embodiment of this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, in an example configuration of a wellhead assembly 11, wellhead assembly 11 includes conductor housing 12. Conductor housing 12 can be associated with a conductor pipe that extends into a well. Tubular wellhead member or wellhead housing 13 with a central axis Ax, is landed within conductor housing 12. Wellhead housing 13 can be a subsea wellhead located over a well (not shown) and also can be a high pressure tubular member having an exterior surface and bore 15. Wellhead housing 13 secures to a first string of casing, which extends through the conductor pipe to a depth into the well. Normally, the first string of casing is cemented in place.

A tubular hanger 17, such as an intermediate casing hanger and the intermediate casing or other tubular 18 that is supported by tubular hanger 17 are installed in wellhead housing 13. Tubular hanger 17 can land within bore 15 can be supported within bore 15 by hanger support 19. Hanger support 19 can be, for example, an annular load ring assembly, or an integral lower shoulder of bore 15. A tubular hanger packoff 20 seals annular cavity 21 which is defined between an outer diameter of tubular hanger 17 and bore 15 of the wellhead housing 13.

Figure 2:
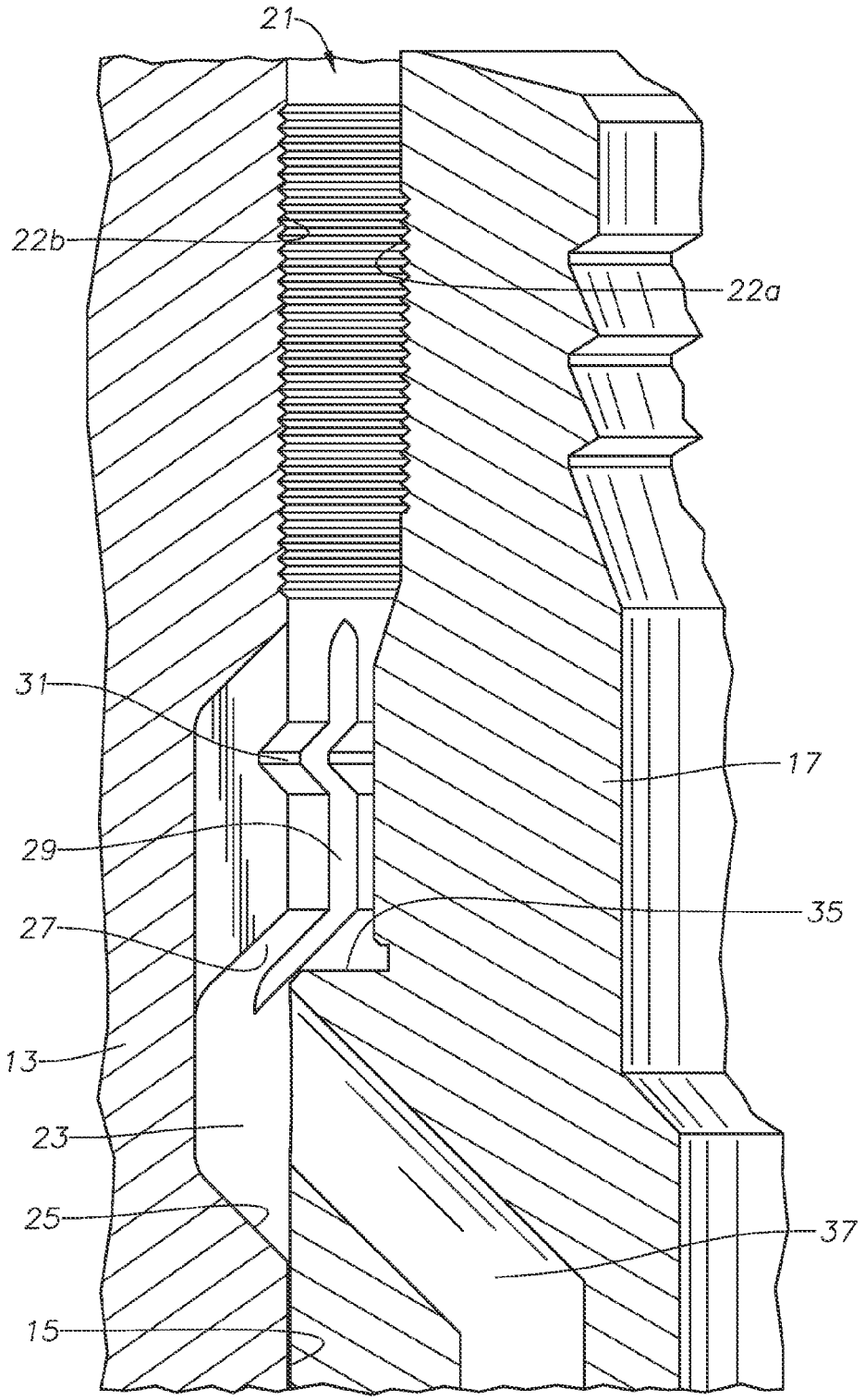
FIG. 2 is a detail section view of the flow-by passage and gallery slot of FIG. 1.
Figure 3:
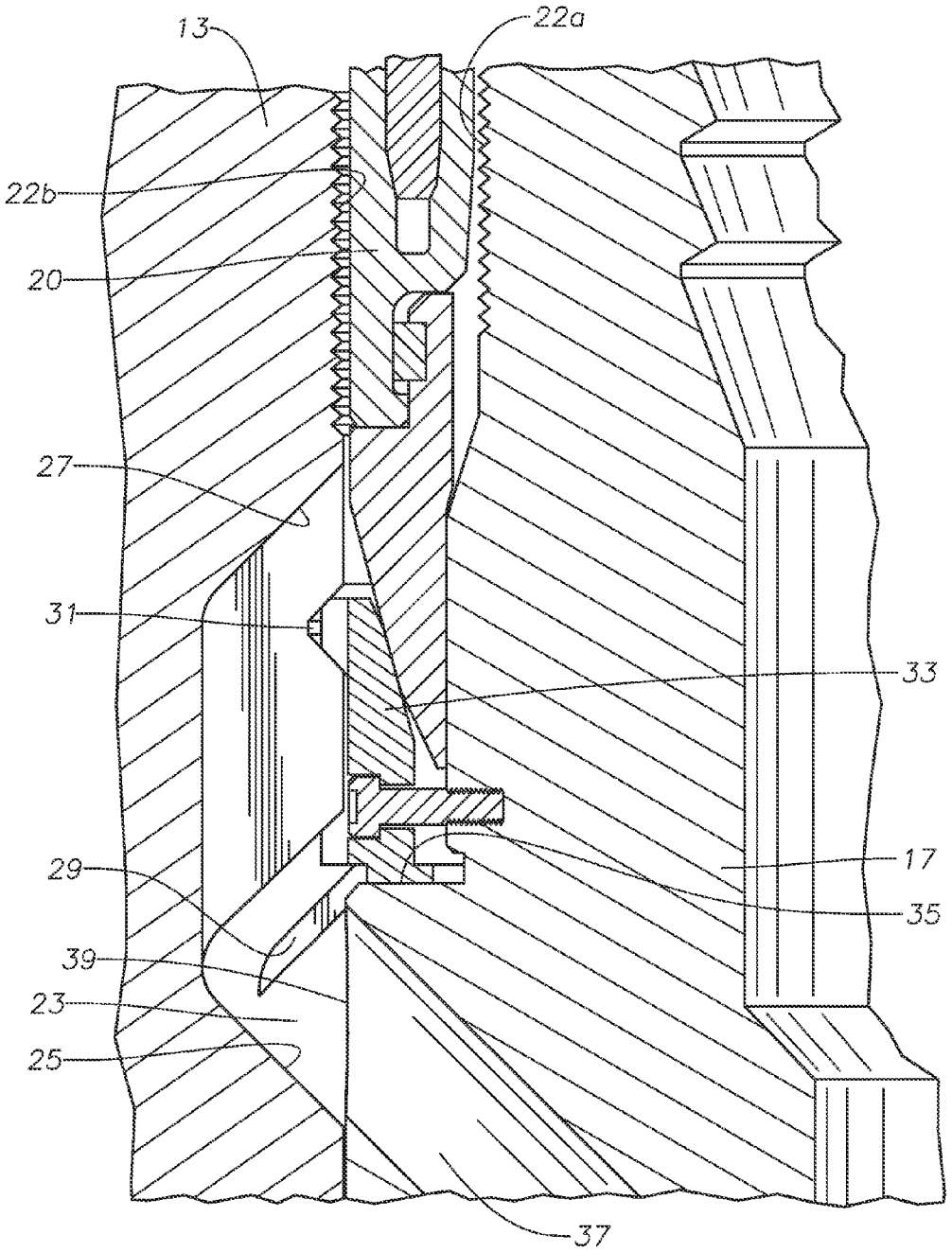
FIG. 3 is a section view of the wellhead assembly of FIG. 1, also showing lock-ring carried by the tubular hanger, in accordance with an embodiment of this disclosure.

Looking at FIGS. 2-3, the outer diameter of tubular hanger 17 can have hanger sealing surface 22*a* that can include a series of circumferentially extending hanger wickers. Bore 15 can have housing sealing surface 22*b* that include a series of circumferentially extending housing wickers. Packoff 20 can engage hanger wickers of hanger sealing surface 22*a* and housing wickers of housing sealing surface 22*b* to assist in forming an maintaining the seal between the outer diameter of tubular hanger 17 and bore 15. In other embodiments sealing surfaces 22*a*, 22*b* can be smooth, or can have an alternate profile to form appropriate sealing surfaces for packoff 20.

Returning to FIG. 1, a second tubular hanger 17', which can be a production casing hanger can be landed on tubular hanger 17 and can support an inner tubular member 18', such as a production casing that extends into the well within tubular 18.

Figure 4:
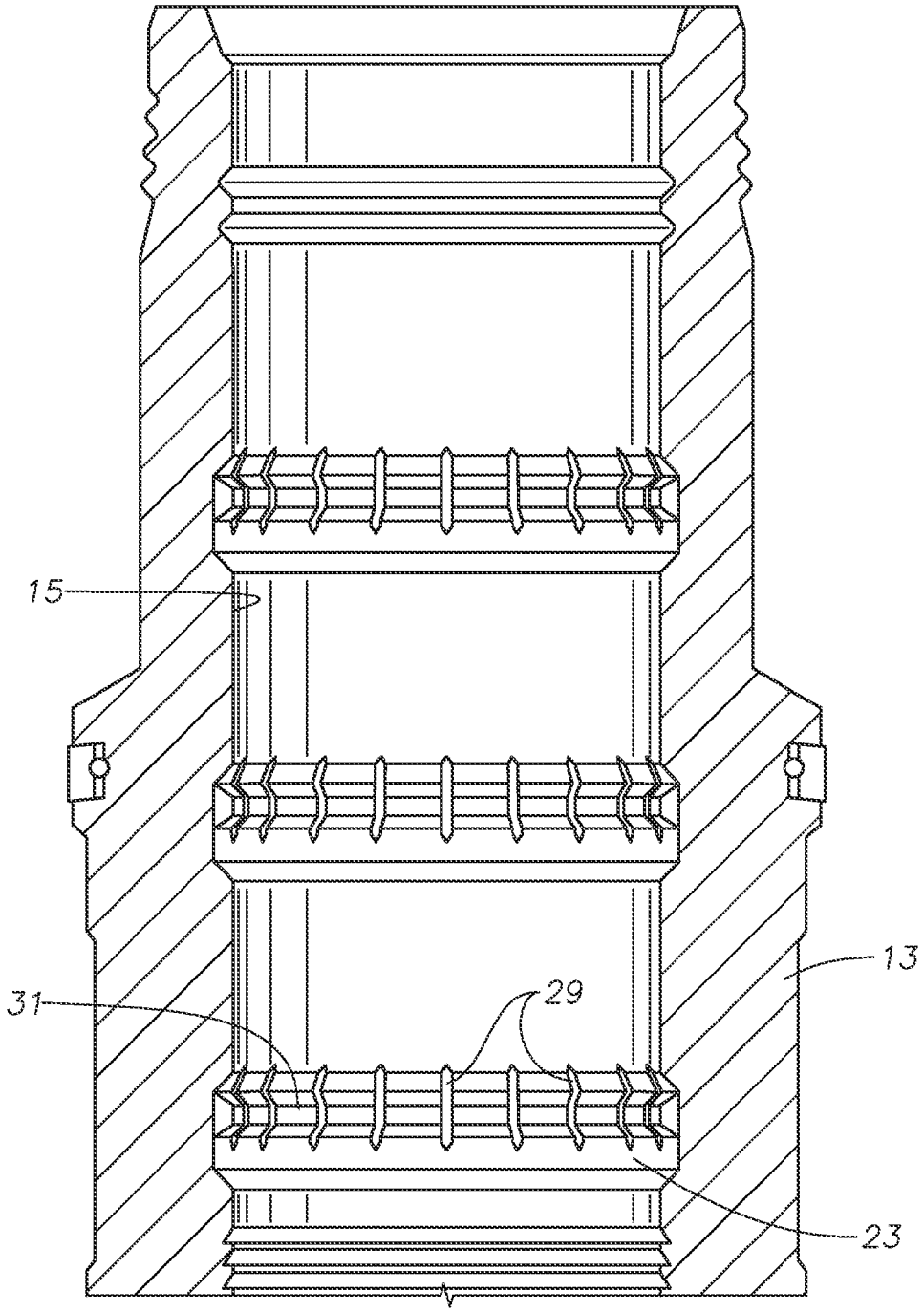
FIG. 4 is a section view of a wellhead housing with a plurality of sections of gallery slots and flow-by passages, in accordance with an embodiment of this disclosure.

Looking at FIGS. 1-4, wellhead housing 13 includes a gallery slot 23. Wellhead housing 13 can have a single gallery slot 23, or a plurality gallery slots 23 spaced axially apart along bore 15 (FIG. 4). Gallery slot 23 is an annular recess defined by an enlarged inner diameter of bore 15. Gallery slot 23 has a sloped upward facing surface 25 and a sloped downward facing surface 27. An outer wall that is generally parallel to axis Ax connects sloped upward facing surface 25 and sloped downward facing surface 27. Gallery slot 23 can be formed by rotating a tool 360 degrees around bore 15 to carve material out of bore 15 and create sloped upward facing surface 25 and sloped downward facing surface 27.

Wellhead housing 13 also includes a plurality of flow-by slots 29. Each flow-by slot 29 extends axially upward from gallery slot 23. Flow-by slots 29 can extend axially upward to a region of bore 15 proximate to housing sealing surface 22*b*. Flow-by slots 29 are grooves in bore 15 and can be formed by removing material from the inner diameter of bore 15 with a tool. The radially outer end of flow-by slots 29 can have a semi-circular shape in cross section. Alternately, the radially outer end of flow-by slots 29 can have a V shape, elliptical shape, or other geometrical shape conducive to allowing a flow of fluid through flow-by slots 29.

Wellhead housing 13 further includes annular notch 31. Annular notch 31 is a groove in bore 15. Annular notch 31 can be formed by rotating a tool 360 degrees around bore 15 to carve material out of bore 15. Annular notch 31 can have a generally V shape in cross section and have a radial depth that is less than a radial depth of flow-by slots 29. Flow-by slots 29 can extend axially upwards past annular notch 31, intersecting annular notch 31.

Annular notch 31 is spaced axially apart from downward facing surface 27 of gallery slot 23. Looking at FIG. 3, downward facing surface 27 and annular notch 31 together define a locking profile for accepting lock-ring 33. Lock-ring 33 secures tubular hanger 17 to wellhead housing 13.

Tubular hanger 17 has an annular upward shoulder 35 on an outer diameter of tubular hanger 17. Lock-ring 33 can be carried by tubular hanger 17 by engaging and resting on annular upward shoulder 35. In the engaged position, a profile on an outer diameter of lock-ring 33 engages downward facing surface 27 and annular notch 31, and continues to engage annular upward shoulder 35, so that tubular hanger 17 cannot move axially upward relative to wellhead housing 13. Lock-ring 33 additionally supports packoff 20 while packoff 20 is being energized to seal between the outer diameter of tubular hanger 17 and bore 15.

Returning to FIGS. 1-4, tubular hanger 17 also has flow-by passage 37. Flow-by passage 37 is a passageway defined within a sidewall of tubular hanger 17 and can have a circular cross section. Tubular hanger 17 can include more than one flow-by passage 37, with flow-by passages 37 being spaced around a diameter of the sidewall of tubular hanger 17.

Flow-by passage 37 is in fluid communication with annular cavity 21 below hanger support 19 and annular cavity 21 above hanger support 19. Flow-by passage 37 has a first end 39 that extends to an outer diameter of tubular hanger 17 and is open to annular cavity 21 above hanger support 19 axially level with gallery slot 23. Flow-by passage 37 therefore intersects with gallery slot 23 and intersects an outer radial surface of tubular hanger 17 so that it opens into gallery slot 23. Sloped upward facing surface 25 is located on an axially lower side of the first end 39 of the flow-by passage 37 and sloped downward facing surface 27 located on an axially upper side of the first end 39 of flow-by passage 37. First end 39 of flow-by passage 37 is spaced axially apart from annular upward shoulder 35 so that flow-by passage 37 does not intersect any portion of annular upward shoulder 35 and instead flow-by passage 37 opens axially between annular upward shoulder 35 and the hanger support 19.

Second end 41 of flow-by passage 37 is in fluid communication with annular cavity 21 below hanger support 19. Second end 41 of flow-by passage 37 can extend generally parallel with axis Ax so that it opens in an annular downward facing shoulder of tubular hanger 17. First end 39 of flow-by passage 37 can be angled relative to second end 41 of flow-by passage 37 so that flow-by passage 37 includes a corner.

In an example of operation, the well will be drilled and conductor housing 12 with the conductor pipe is lowered into the well. Wellhead housing 13 is landed within conductor housing 12, and tubular hanger 17 with tubular 18 is supported by wellhead housing 13. Tubular hanger packoff 20 is not yet set. Lock-ring 33 can be moved to an engaged position by dogs or other means, and can engage downward facing surface 27 and annular notch 31 and secure tubular hanger 17 to wellhead housing 13. In an engaged position, because the radial depth of annular notch 31 that is less than the radial depth of flow-by slots 29, lock-ring 33 does not protrude into the full radial depth of flow-by slots 29 and fluids can flow through flow-by slots 29 when lock-ring 33 is in the engaged position.

The well can be pressurized to force a fluid upward through the flow-by passage 37 that follows a path through the annular cavity below hanger support 19, through an outer radial surface of tubular hanger 17 into gallery slot 23, and into the annular cavity above hanger support 19. Fluids can alternately take an opposite path travelling downward into the well.

As an example, well fluid, such as mud or cement, can be pumped downward into the well and can return upward through flow-by passage 37, and into gallery slot 23. Therefore the well fluid has passed by hanger support 19 by way of flow-by passage 37 and travels into gallery slot 23 at an axial elevation below annular upward shoulder 35. The well fluid can then continue upwards through flow-by slots 29 and into annular cavity 21 above annular upward shoulder 35. After completion of the well fluid pumping process, packoff 20 can be installed and energized to seal between the outer diameter of tubular hanger 17 and bore 15.

In the example of FIG. 1, second tubular hanger 17', with inner tubular member 18', can be landed on tubular hanger 17. Second lock-ring 33' can be moved to an engaged position by dogs or other means, and can engage downward facing surface 27' and annular notch 31' and secure second tubular hanger 17' to wellhead housing 13. A well fluid, such as mud or cement, can be pumped downward into the well and can return upward through flow-by passage 37', and into gallery slot 23'. The well fluid can then continue upwards through flow-by slots of second tubular hanger 17' and into an annular cavity above annular upward shoulder 35'.

After completion of this well fluid pumping process, packoff 20' can be installed and energized to seal between the outer diameter of second tubular hanger 17' and bore 15. This process can be repeated for any additional tubular hangers of wellhead assembly 11.

By positioning flow-by passages 37 of tubular hanger 17 below and away from annular upward shoulder 35, annular upward shoulder 35 can better be used as a bearing interface and tubular hanger 17 can be stronger than if flow-by passages 37 extended through annular upward shoulder 35. Embodiments of this disclosure can provide additional flow capacity because the size of the flow-by passages 37 and flow-by slots 29 can be increased without taking material out of annular upward shoulder 35. Furthermore, lock-ring 33 can be integral to the tubular hanger 17 because lock-ring 33 will not interfere with the flow of fluids through flow-by slots 29.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A wellhead assembly comprising:

a tubular wellhead housing having a bore and an annular gallery slot, the annular gallery slot defined by an enlarged inner diameter of the bore;

a plurality of circumferentially spaced flow-by slots formed in the tubular wellhead housing and extending radially upward from the gallery slot and axially outward from the bore, wherein portions of the wellhead housing circumferentially between the flow-by slots include a downward facing surface at least partially defining the annular gallery slot, and a notch above the downward facing surface, the downward facing surface and the notch forming a locking profile;

a tubular hanger selectively landed in the bore of the wellhead housing defining an annular cavity between the bore and an outer diameter of the tubular hanger, the tubular hanger supported by the wellhead housing with a hanger support located in the annular cavity; and a flow-by passage in fluid communication with the annular cavity at locations above and below the hanger support, and that intersects with the gallery slot and intersects an outer radial surface of the tubular hanger.

2. The wellhead assembly of claim 1, wherein the tubular hanger has an annular upward shoulder on an outer diameter and the flow-by passage is spaced axially apart from the annular upward shoulder.

3. The wellhead assembly of claim 1, wherein the tubular hanger has an annular upward shoulder on an outer diameter and a first end of the flow-by passage opens axially between the annular upward shoulder and the hanger support.

4. The wellhead assembly of claim 1, wherein the wellhead housing has a housing sealing surface on the bore, each of the flow-by slots extending from the gallery slot to a region proximate to the housing sealing surface.

5. The wellhead assembly of claim 1, wherein the locking profile formed by the downward facing surface and the notch corresponds to a lock-ring that selectively secures the tubular hanger to the wellhead housing.

6. The wellhead assembly of claim 1, wherein the flow-by passage extends to an outer diameter of the tubular hanger axially level with the gallery slot.

7. The wellhead assembly of claim 1, further comprising a lock-ring carried by the tubular hanger, the lock-ring engaging an annular upward shoulder on an outer diameter of the tubular hanger.

8. The wellhead assembly of claim 1, wherein the flow-by slots extend axially upward from the gallery slot past the notch.

9. A wellhead assembly comprising:

a tubular wellhead housing having:

a bore;

an annular gallery slot, the annular gallery slot defined by an enlarged inner diameter of the bore; and a plurality of flow-by slots, the flow-by slots being circumferentially spaced and extending axially upward from the gallery slot and axially outward from the bore, wherein portions of the wellhead housing circumferentially between the flow-by slots include a downward facing surface at least partially defining the annular gallery slot, and a notch above the downward facing surface, the downward facing surface and the notch forming a locking profile;

a tubular hanger selectively landed in the bore of the wellhead housing defining an annular cavity between the bore and an outer diameter of the tubular hanger, the tubular hanger supported by the wellhead housing with a hanger support located in the annular cavity;

an annular upward shoulder on an outer diameter of the tubular hanger;

a flow-by passage having a first end open to the annular cavity above the hanger support axially level with the gallery slot, and a second end in fluid communication with the annular cavity below the hanger support; and wherein the first end of the flow-by passage is spaced axially apart from the annular upward shoulder.

10. The wellhead assembly of claim 9, wherein the first end of the flow-by passage extends to an outer diameter of the tubular hanger.

11. The wellhead assembly of claim 9, wherein the gallery slot is at least partially defined by a sloped upward facing surface located on a lower side of the gallery slot.

12. The wellhead assembly of claim 9, wherein the notch is axially spaced from the gallery slot, and the locking profile corresponds to a lock-ring that selectively secures the tubular hanger to the wellhead housing.

13. The wellhead assembly of claim 12, wherein the wellhead housing has a series of circumferentially extending wickers on the bore and wherein the flow-by slots extend axially upward from the gallery slot past the notch to a region proximate to the wickers.

14. The wellhead assembly of claim 9, further comprising a lock-ring carried by the tubular hanger, the lock-ring engaging the annular upward shoulder.

15. A method for completing a well with a wellhead assembly, the method comprising:

(a) supporting a tubular hanger within a bore of a tubular wellhead housing with a hanger support, to define an annular cavity between the bore and an outer diameter of the tubular hanger, the wellhead housing having an annular gallery slot defined by an enlarged inner diameter of the bore and a plurality of circumferentially spaced flow-by slots formed in the tubular wellhead housing and extending radially upward from the gallery slot and axially outward from the bore, wherein portions of the wellhead housing circumferentially between the flow-by slots include a downward facing surface at least partially defining the annular gallery slot, and a notch above the downward facing surface, the downward facing surface and the notch forming a locking profile; and (b) pressurizing the well to force a fluid upward through a flow-by passage that follows a path through the annular cavity below the hanger support, through an outer radial surface of the tubular hanger into the gallery slot, and into the annular cavity above the hanger support.

16. The method of claim 15, wherein the tubular hanger has an annular upward shoulder on an outer diameter and the flow-by passage is spaced axially apart from the annular upward shoulder, the method further comprising carrying a lock-ring on the annular upward shoulder of the tubular hanger.

17. The method of claim 16, further comprising securing the tubular hanger to the wellhead housing by engaging the lock-ring with the locking profile.

18. The method of claim 15, wherein step (b) includes returning the well fluid upward through the flow-by slots.

19. The method of claim 15, wherein the tubular hanger has an annular upward shoulder on an outer diameter and wherein the flow-by passage extends to an outer diameter of the tubular hanger to the annular cavity above the hanger support, and step (b) includes returning the well fluid through the flow-by passage to the outer diameter of the tubular hanger axially below the annular upward shoulder.

* * * * *